US010094350B2

(12) United States Patent
Filippi et al.

(10) Patent No.: US 10,094,350 B2
(45) Date of Patent: Oct. 9, 2018

(54) INJECTION VALVE

(71) Applicant: Continental Automotive GmbH, Hannover (DE)

(72) Inventors: Stefano Filippi, Castel' Anselmo Collesalvetti (IT); Mauro Grandi, Leghorn (IT); Francesco Lenzi, Leghorn (IT); Valerio Polidori, Leghorn (IT)

(73) Assignee: CONTINENTAL AUTOMOTIVE GMBH, Hanover (DE)

( * ) Notice: Subject to any disclaimer, the term of this patent is extended or adjusted under 35 U.S.C. 154(b) by 195 days.

(21) Appl. No.: 15/029,352

(22) PCT Filed: Oct. 13, 2014

(86) PCT No.: PCT/EP2014/071838
§ 371 (c)(1),
(2) Date: Apr. 14, 2016

(87) PCT Pub. No.: WO2015/055553
PCT Pub. Date: Apr. 23, 2015

(65) Prior Publication Data

US 2016/0258405 A1 Sep. 8, 2016

(30) Foreign Application Priority Data

Oct. 14, 2013 (EP) ..... 13188542

(51) Int. Cl.
*F02M 61/20* (2006.01)
*F02M 61/08* (2006.01)
*F02M 63/00* (2006.01)

(52) U.S. Cl.
CPC ..... *F02M 61/08* (2013.01); *F02M 61/20* (2013.01); *F02M 63/0073* (2013.01);
(Continued)

(58) Field of Classification Search
CPC .... F02M 61/08; F02M 61/20; F02M 63/0073; F02M 2200/26; F02M 2200/50;
(Continued)

(56) References Cited

U.S. PATENT DOCUMENTS 4,715,541 A 12/1987 Freudenschuss et al. ..... 239/533.4
6,676,035 B2 1/2004 Lorraine et al. ..... 239/102.2
2010/0025501 A1* 2/2010 Maragliulo ..... F02M 51/061 239/584

FOREIGN PATENT DOCUMENTS

AT 394760 B 6/1992 ..... F02M 45/08
EP 1079098 A2 2/2001 ..... F02M 51/06
(Continued)

OTHER PUBLICATIONS

Korean Notice of Allowance, Application No. 2017015365183, 3 pages, dated Feb. 28, 2017.
(Continued)

*Primary Examiner* — Jason Boeckmann
(74) *Attorney, Agent, or Firm* — Slayden Grubert Beard PLLC

(57) ABSTRACT

The present disclosure relates to an injection valve. The valve may comprise a fluid inlet tube with a recess, a valve body, a valve needle, a spring element, and an elastic body. The valve body may have a central longitudinal axis and a cavity with a fluid outlet portion. The valve needle may be arranged in the recess of the fluid inlet tube and movable in the cavity. The spring element and elastic body may be arranged in the recess and interact with a portion of the valve body on one side and with a spring rest fixed to the valve needle on another side. The elastic body and the spring element are compressed as the valve needle is moved along the longitudinal axis away from its closing position. The elastic body, in the presence of a fluid pressure in the recess,
(Continued)

exerts a fluid-pressure-dependent longitudinal force on the valve needle.

10 Claims, 4 Drawing Sheets

(52) U.S. Cl.
CPC ..... *F02M 2200/26* (2013.01); *F02M 2200/50* (2013.01); *F02M 2200/9015* (2013.01)

(58) Field of Classification Search
CPC ..... F02M 2200/9015; F02M 2200/31; F02M 2200/306; F02M 61/205
See application file for complete search history.

(56) References Cited

FOREIGN PATENT DOCUMENTS

| | | | | |
|---|---|---|---|---|
| FR | 2914024 | A1 | 9/2008 | ..... F02M 61/10 |
| JP | 2004513278 | A | 4/2004 | ..... F02M 51/00 |
| JP | 2004515672 | A | 5/2004 | ..... F02M 51/00 |
| KR | 102001025057 | A | 3/2001 | ..... F02M 51/06 |
| KR | 102001043661 | A | 5/2001 | ..... F02M 51/06 |
| WO | 2015/055553 | A1 | 4/2015 | ..... F02M 61/08 |

OTHER PUBLICATIONS

European Search Report, Application No. 13188542.8, 5 pages, dated Mar. 11, 2014.
International Search Report and Written Opinion, Application No. PCT/EP2014/071838, 9 pages, dated Nov. 18, 2014.

* cited by examiner

INJECTION VALVE

CROSS-REFERENCE TO RELATED APPLICATIONS

This application is a U.S. National Stage Application of International Application No. PCT/EP2014/071838 filed Oct. 13, 2014, which designates the United States of America, and claims priority to EP Application No. 13188542.8 filed Oct. 14, 2013, the contents of which are hereby incorporated by reference in their entirety.

TECHNICAL FIELD

The disclosure is related to a valve and specifically to injection valves used in internal combustion engines.

BACKGROUND

Injection valves may be used in internal combustion engines, in order to dose the fluid into an intake manifold of the internal combustion engine or directly into the combustion chamber of a cylinder of the internal combustion engine, for instance. The injection valves are operable in a wide pressure range, so that the valves may also provide low minimum flow quantities. In addition, the size of the actuators used in the injection valves to actuate a needle of the injection valve should be reduced to fit the dedicated engine cavity.

SUMMARY

In some embodiments, an injection valve comprises a fluid inlet tube with a recess and a valve body having a central longitudinal axis. The valve body comprises a cavity with a fluid outlet portion. The fluid inlet tube and the valve body may be two sections of a one-piece part. In some embodiments, however, the fluid inlet tube and the valve body are individual parts which are mechanically fixed and hydraulically coupled to one another. The fluid inlet tube and the valve body may be arranged such that the cavity of the valve body extends the recess of the fluid inlet tube in longitudinal direction towards the fluid outlet portion.

A valve needle is arranged in the recess of the fluid inlet tube and is movable in the cavity along the central longitudinal axis, the valve needle preventing a fluid flow through the fluid outlet portion in a closing position and releasing the fluid flow through the fluid outlet portion in other positions. That the valve needle is arranged in the recess of the fluid inlet tube and is movable in the cavity along the central longitudinal axis means that a portion of the valve needle is positioned in the recess of the fluid inlet tube and another portion of the valve needle is positioned in the cavity of the valve needle. For example, the valve needle extends in longitudinal direction from a tip portion at one axial end of the valve needle to a rear portion at an opposite axial end of the valve needle. The portion of the valve needle which is located in the recess may be the rear portion or a portion adjacent to the rear portion and the portion located in the cavity may be the tip portion or a portion adjacent to the tip portion.

A spring element and an elastic body are configured and arranged in the recess such that the elastic body and the spring element are compressed as the valve needle is moved along the longitudinal axis away from its closing position. In some embodiments, the spring element and the elastic body are arranged in the recess and interact with a portion of the valve body on one side and with a spring rest which is fixed to the valve needle on another side such that the elastic body and the spring element are compressed as the valve needle is moved along the longitudinal axis away from its closing position. For example, the spring element and the elastic body are seated against said portion of the valve body and against said spring rest.

The valve needle may be actuated by means of an actuator provided in the injection valve in order to obtain a fluid flow through the fluid outlet portion. Subsequent to the actuation, the spring element causes the valve needle to move back to its closing position.

The elastic body may be operable, in the presence of a fluid pressure in the recess, to exert a longitudinal force on the valve needle which longitudinal force (also denoted as "longitudinal force Fe" in the following) is dependent on the fluid pressure.

The elastic body may be radially spaced apart from the spring element, and is intended to compensate for a force acting on the valve needle caused by a fluid pressure in the cavity during operation. This results in a reduced or even eliminated influence of the fluid pressure on the functionality of the injection tube. As there is no need for further compensation means, the actuator unit dimensions can be kept small and, consequently, a minimum controllable fluid quantity can be reduced since the actuator becomes faster. Hydraulically balancing elements, such as bellows or a dry actuator, are made redundant.

In particular, the fluid pressure on the elastic body results in a longitudinal force Fe on the valve needle that is directed in an opposite direction as compared to the longitudinal force Ff on the valve needle caused by the fluid pressure.

Furthermore, force Fe increases as the fluid pressure increases, in particular linearly or essentially linearly. The force of the spring element, in contrast, is virtually independent of the fluid pressure.

In some embodiments, the elastic body is a plastic body made from an elastomer material. With such an elastic body, the pressure-dependent longitudinal force is particularly easily achievable.

In some embodiments, during operation of the valve and in the presence of the fluid pressure in the recess, the fluid pressure acting on radial side faces of the elastic body causes the longitudinal force that compensates—e.g., partly compensates, fully compensates, or slightly overcompensates—for the longitudinal force on the valve needle caused by the fluid pressure. In other words, the elastic body translates a radial force onto the elastic body caused by the fluid pressure into a fluid pressure dependent longitudinal force.

The radial side faces may be exposed to the fluid while top and bottom portions of an outer surface of the elastic body which extend between the side surfaces are not exposed to the fluid. For example, the top and bottom portions abut a portion of the valve body and the spring seat, respectively. With advantage, the hydraulic force on the surface of the elastic body is non-uniform. The hydraulic force due to the fluid pressure on the radial side faces may in particular influence the stiffness of the elastic body in longitudinal direction in such way that said stiffness increases with increasing fluid pressure.

In some embodiments, the valve needle is connected to and/or positionally fixed with respect to a spring rest, said spring rest simultaneously acting on the spring element and the elastic body as the valve needle is moved along the longitudinal axis away from its closing position. The spring rest may be located in the recess of the fluid inlet tube. The spring element and the elastic body may interact with the valve needle by means of the spring rest for biasing the valve needle towards the closing position.

The spring rest may be a washer fixed to the valve needle, for instance. A first portion of the spring rest may be in direct mechanical contact with spring element, whereas a second portion may be in direct mechanical contact with the elastic body. The second portion may be arranged closer to the longitudinal axis than the first portion, for instance. This arrangement facilitates the valve needle to simultaneously interact with the spring element and the elastic body.

In some embodiments, the elastic body is an elastic ring, the elastic ring being arranged in a plane extending perpendicularly to the longitudinal axis. For example, the elastic ring extends circumferentially around the longitudinal axis and preferably also around the valve needle. The elastic ring may be rotationally symmetric with respect to the longitudinal axis. This ensures that the force Fe is easily exerted along the longitudinal axis.

In some embodiments, the elastic body is configured such that in the absence of a fluid pressure and in the closing position of the valve needle, the elastic body is squeezed by at least 5% and by at most 25%, preferably by at least 10% and by at most 20% of its original longitudinal extension, wherein the boundaries of the ranges are included in each case. It turns out that this results in the best elastic body yields during the lifetime of the elastic body.

In some embodiments, the injection valve comprises an electromagnetic actuator, the electromagnetic actuator being designed such that $dFm/dz<Kv$ holds, wherein Fm is a magnetic force as a function of the position z on the longitudinal axis and Kv is a spring rate of the valve. In particular, the electromagnetic actuator may be designed such that a saturation magnetic flux at a predefined hold drive current Ihold results in a stable final position. Consequently, a hard stop to limit the lift during movement of the needle may be dispensed with, so that the risk of wearing and hydraulic sticking caused by a hard stop over the lifetime of the injection valve is eliminated.

In some embodiments, the injection valve is of an outward opening type. In this case, the tip portion of the valve needle in particular projects out of the valve body in longitudinal direction. The valve needle is movable away from the closing position in this case in a longitudinal direction which is directed from the fluid inlet tube towards the fluid outlet portion.

By means of the elastic body, the closing function is ensured even in the presence of comparably high fluid pressure in this configuration variant. This allows for a design of the injection valve that reliably operates over a wide pressure range. In particular, the injection valve is able to operate at comparably low pressure, for instance at a pressure between 5 bar and 10 bar. In a combustion engine, this pressure range may be used for a limp home emergency function. In the high pressure range, for instance at pressures above 100 bar, an unintentional opening of the valve, due to a force which is induced by the fluid pressure and tries to open the valve, is reliably avoided by means of the counteracting force Fe caused by the elastic body.

In some embodiments, the injection valve is of an inward opening type. In this case, the tip portion of the valve needle is in particular positioned within the cavity of the valve body. The valve needle is movable away from the closing position in this case in a longitudinal direction which is directed from the fluid outlet portion towards the fluid inlet tube.

Here, the elastic body in particular results in a reduced or even eliminated dependence of the injected minimum fluid quantity on the fluid pressure.

BRIEF DESCRIPTION OF THE DRAWINGS

Exemplary embodiments are explained in the following with the aid of schematic drawings. In the Figures.

In these figures, elements of the same design and/or function are identified by the same reference numerals.

DETAILED DESCRIPTION

Figure 1:
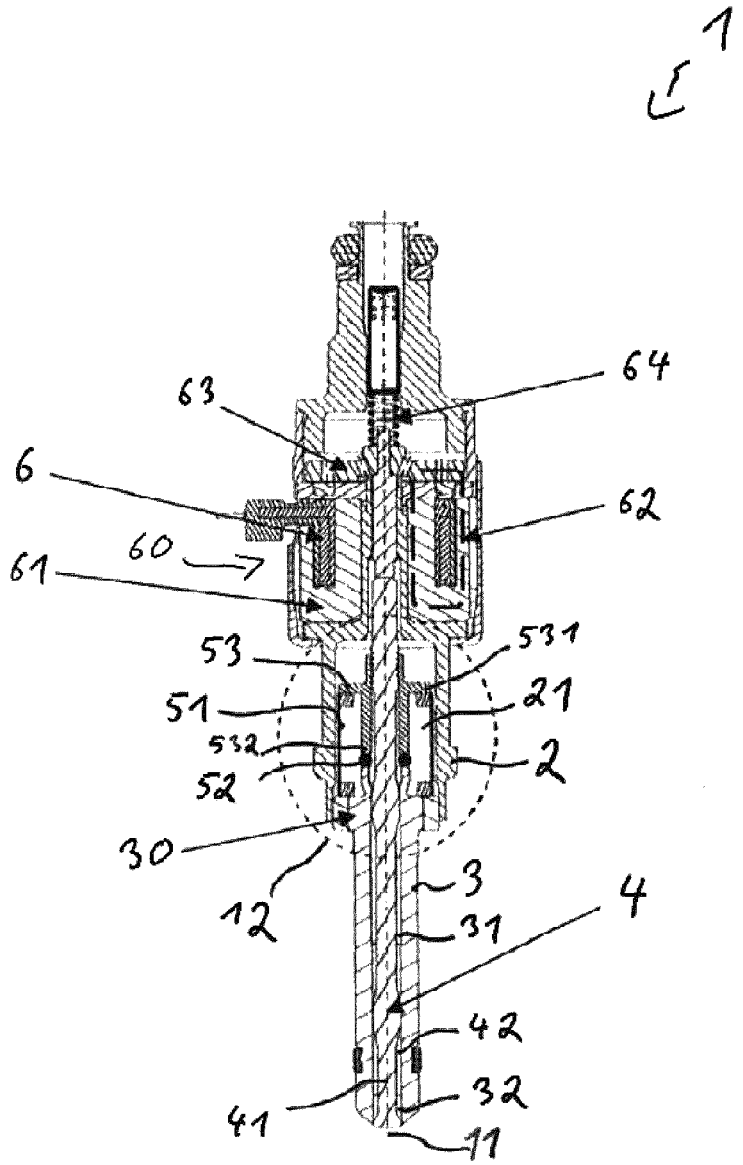
FIG. 1 shows an injection valve in a longitudinal sectional view.
Figure 2:
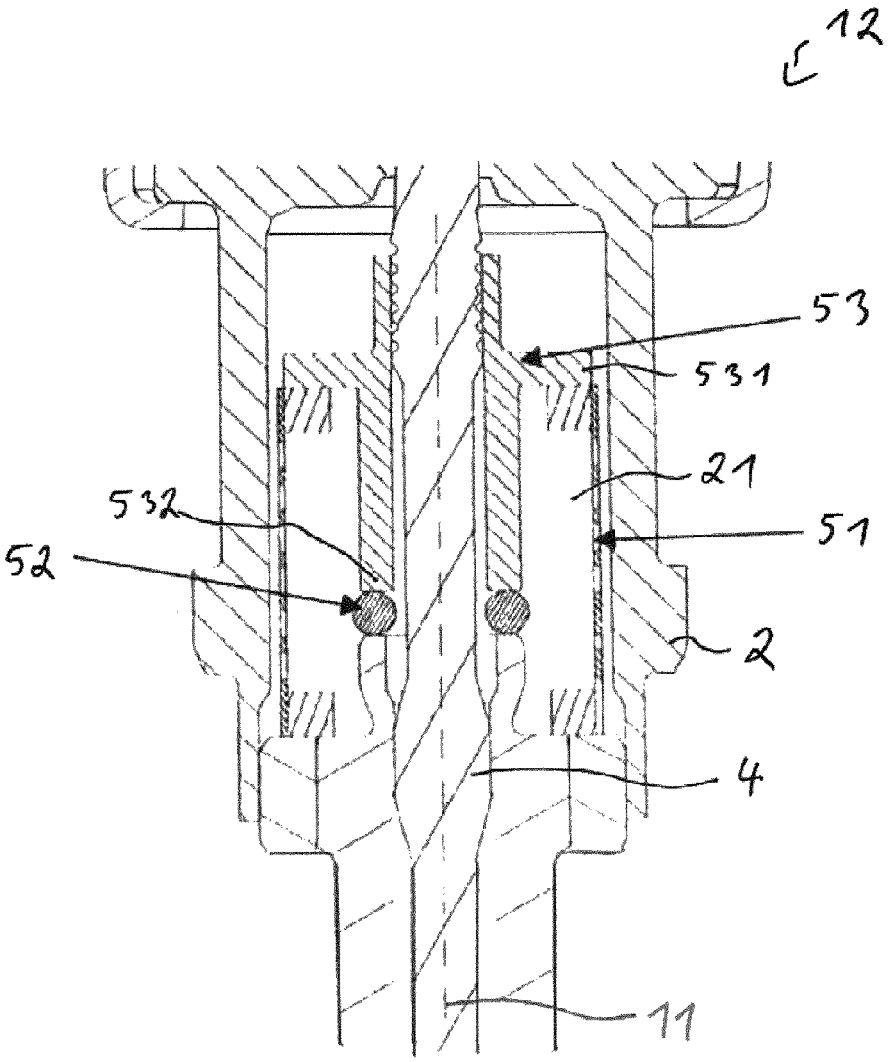
FIG. 2 shows a detail view of a section of the injection valve shown in FIG. 1.

FIG. 1 shows an injection valve 1 which is suitable for dosing fluids, for example fuel such as diesel or gasoline. A detail view of a portion 12 is shown in FIG. 2. In this exemplary embodiment the injection valve 1 is embodied as an injection valve of outward opening type configured to dose fuel to an internal combustion engine. The injection valve comprises a valve assembly 30, a fluid inlet tube 2 and an actuator unit 6.

The valve assembly 30 includes a valve body 3 with a central longitudinal axis 11. The valve body 3 is mechanically connected to the fluid inlet tube 2. The valve body has a cavity 31. A valve needle 4, arranged in the cavity, is movable in axial direction running parallel to the longitudinal axis 11 with respect to the valve body 3.

The cavity 31 is hydraulically coupled to a recess 33 of the fluid inlet tube 2 and a fuel connector. The fuel connector is designed to be connected to a high pressure fuel chamber e.g., a fuel rail, of an internal combustion engine, in which the fuel is stored under high pressure.

On one of the free ends of the cavity 31, a fluid outlet portion 32 is formed, which is closed or opened depending on the axial position of the valve needle 4. When the valve needle 3 is displaced away from the closing position, there is a gap between the valve body 3 and the valve needle at an axial end of the injection valve 1 facing away from the actuator unit 6. The gap forms a valve nozzle.

Furthermore, the valve needle 4 has a lower needle portion 41. The lower needle portion has a groove 42. The groove is of an annular shape. The groove 42 allows fluid to flow to the fluid outlet portion 32. The fluid outlet portion 32 is closed or opened depending on the axial position of the valve needle 4.

At an axial end of the lower needle portion 41 facing away from the fluid inlet tube 2, the valve needle 4 has a tip 43. Preferably, the tip 43 is conical. The tip cooperates with the valve body 20 to prevent or enable the fluid flow through the fluid outlet portion 28.

The fluid is led from the fluid inlet tube 2 to the lower needle portion 41 to be led on through the groove 42 to the fluid outlet portion 32 near the tip 43 of the valve needle 4. The valve needle prevents a fluid flow through the fluid outlet portion in the valve body 3 in a closing position of the valve needle.

The valve assembly 14 is provided with an actuator unit 6, which exemplarily is an electro-magnetic actuator. Of course, another type of actuator unit such as a piezoelectric actuator may be used instead.

The electro-magnetic actuator unit comprises a coil 60, which is arranged inside a housing 61. Furthermore, a magnetic path 62 is illustrated in FIG. 1. The electro-magnetic actuator unit 6 further comprises an armature 63. The armature is coupled to the valve needle 4 and is axially movable along the central longitudinal axis 11. The coil 60 is arranged such as to interact with the armature, in particular to move the armature into the direction of the fluid outlet portion 32.

The armature cooperates with the valve needle 4 such that at least part of the lift generated by the coil 60 with respect to the armature 63 is transferred to the valve needle 4, thereby moving the valve needle in its opening position. Furthermore, the injection valve comprises a calibration spring 64 that is arranged on the side of the armature which faces away from the fluid outlet portion 32 and interacts with the armature 63.

A spring element 51 is arranged in the recess 33 provided in the fluid inlet tube 2. The recess 33 forms part of the cavity 31.

The spring element 51 is configured to act on the valve needle 4 such as to move the valve needle in the axial direction into its closing position and/or to retain the valve needle in its closing position. In particular, the spring element 51 forces the valve needle 4 towards the actuator unit 6 once the actuator unit is de-energized, so that the valve needle moves back into its closing position. The spring element may be a standard metallic spring or a 3D tube spring to have a higher spring rate, for instance.

Furthermore, an elastic body 52 is arranged in the recess 21. The elastic body is arranged such that it is compressed as the valve needle 4 is moved away from its closing position. The elastic body 52 exerts a longitudinal force Fe on the valve needle 4.

For instance, the valve needle 4 comprises a spring rest 53. The spring rest may be a washer, for instance. The spring element 51 and the elastic body 52 are arranged between the spring rest 34 of the valve needle 4 and a portion of the valve body 3 that supports the spring element 30 and the elastic body. The spring rest is shaped and arranged such that the spring element 51 and the elastic body 52 are simultaneously compressed as the valve needle 4 is moved away from its closing position. A first portion 531 of the spring rest 53 is in mechanical contact with the spring element 51. A second portion 532 of the spring rest, which is located closer to the longitudinal axis than the first portion, is in mechanical contact with the elastic body.

Figure 3A:
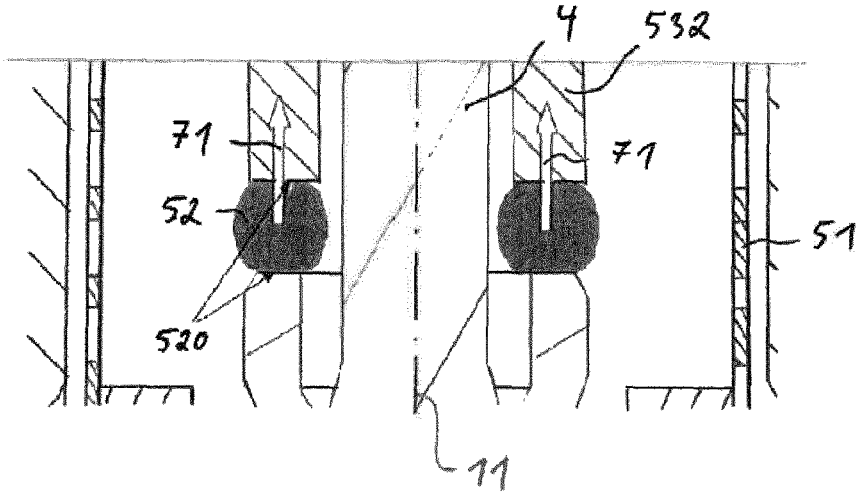
FIGS. 3A and 3B shows further detail views to illustrate the function of the injection valve without (FIG. 3A) and with (FIG. 3B) fluid under pressure.

The elastic body 52 is of annular shape, for instance. In particular, the elastic body is rotationally symmetric with respect to longitudinal axis 11. An arrow 71 shown in FIG. 3A illustrates the Force Fe exerted by the elastic body in the absence of a fluid pressure in the recess 21. The elastic body forms sealing surfaces 520 on both sides of the elastic body with respect to the longitudinal direction, i.e. in particular a top portion of the surface of the elastic body 52 sealingly abuts the spring rest 53 and a bottom portion of the surface sealingly abuts the valve body 51.

The combination of the elastic body 52 and the spring element 51 exerts a longitudinal force acting between the needle 44 and the valve body 3 so that tip 50 is pressed against the valve body to reliably seal the fluid outlet portion 32 once the actuator unit 6 is de-energized. During fabrication of the injection valve, the spring rest 53 may be moved relative to the valve needle 4 to compress the elastic body 52 and spring element 51 until the combined longitudinal force exerted by elastic body 52 and spring element 51 has reached a target force, for instance a force of between 50 N and 100 N. In this position, the spring rest may be permanently and mechanically stably fixed to the valve needle, for instance by crimping or by means of laser radiation. In that position, the elastic body is preferably squeezed by at least 5% and by at most 25%, in particular by at least 10% and by at most 20% of its original longitudinal extension, in order to obtain the best elastic body yields during its lifetime.

Figure 3B:
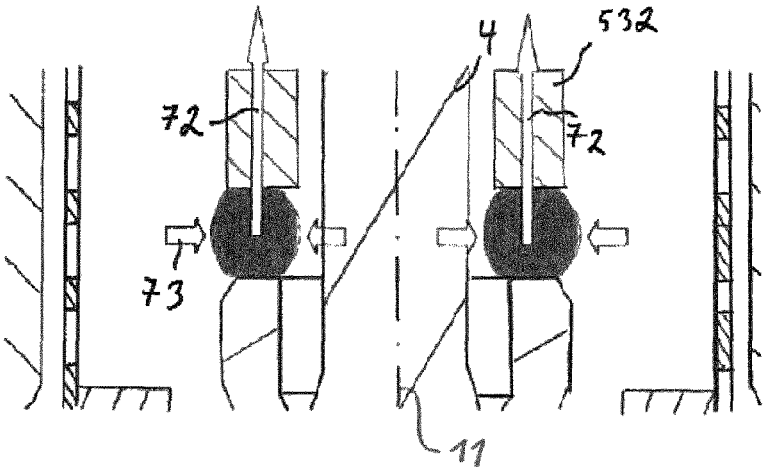

As shown in FIG. 3B, a fluid under pressure in the recess 21 results in a force (arrows 73) that radially compresses the elastic body 52. The elastic body translates this force into an additional pressure-dependent component of force Fe (illustrated by arrows 71).

Figure 4:
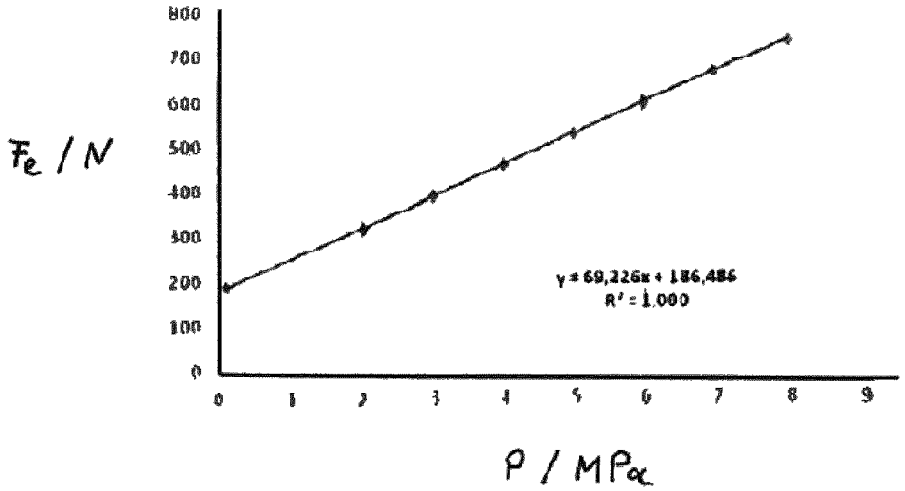
FIG. 4 shows exemplary simulation results for the longitudinal force Fe caused by the elastic body as a function of the fluid pressure P.

FIG. 4 shows simulation results of force Fe for an elastic body in o-ring geometry. Here, Fe(E,D,d,P) is plotted as a function of the pressure, wherein E is Young's modulus, D is the external diameter and d the cord diameter of the elastic body. The simulation results clearly show that force Fe essentially linearly increases as the pressure increases. Of course, both the value of Fe at zero pressure as well as the slope may be varied by means of modifications to the elastic body as required.

The pressure dependent force Fv on the valve is given by the formula $$Fv(P)=Fe(E,D,d,P)+z0*K-A0*P,$$

where z0 is the longitudinal position in the closing position, K is the spring rate of spring element 51 and A0 is the sealing area of the nozzle tip.

This means that the injection valve 1 is perfectly balanced with respect to the pressure, if force Fe(E,D,d,P) equals A0*P. Consequently, the valve may be operated in a broad pressure range. An additional pressure compensation means may be dispensed with so that the external dimensions of the injection valve may be kept small.

Of course, the elastic body 52 may also improve the performance of the valve if Fe only partially compensates or slightly overcompensates the force acting on the valve caused by the fluid pressure.

In some embodiments, the spring rate K of the spring element 51 dominates over the stiffness of the elastic body 52, so that the elastic body compensates for the pressure dependent force whereas the spring rate K is mainly responsible for the opening/closing dynamics.

A material for the elastic body 52 may be chosen to minimize the temperature dependence of the hardness and the Young's modulus within the application range, for instance between −40° C. and +150° C., so that the behavior of the elastic body is precisely predictable. For instance, the elastic element may contain an elastomer material such as a fluoro-elastomer material (FKM), a GLT-like, GFLT-like (provided by DuPont de Nemours) or VPL-like material (provided by Solvay plastics). Said materials are commonly used for O-rings, for instance. Of course any other elastic material compatible with aggressive gasoline and operable in the given application range may be used.

In some embodiments, the elastic body 52 may also be used in an injection valve of an inward opening type in order to provide an injection valve which is balanced with respect to the pressure.

In this configuration, the pressure compensation by means of the elastic body may result in pressure-independent transient behavior and reduce or even eliminate the dependence of the minimum injected quantity in the ballistic regime on the fluid pressure. This effect can be obtained for an injection valve of an outward opening type as well.

Furthermore, as the balanced injection valve is not pressure-sensitive, a final equilibrium position can be found by a magnetic force sustained by an electrical hold current Ihold and the combined elastic force provided by the calibration spring 64 and the spring element 51. Preferably, the magnetic actuator unit is designed such that a saturation flux at Ihold level is obtained and the spring rate dominates the gradient of the magnetic force dF/dz. Thus, a minor variation of the drive setting parameters and stochastic fluctuations of that current level do not affect the final position of the lift and a stable flow rate downstream of the valve is obtained.

Therefore, a hard stop may be dispensed with, so that flow rate deviations over the lifetime of the valve due to mechanical contact wearing and hydraulic sticking may be avoided.

What is claimed is:

1. An injection valve comprising:

a fluid inlet tube with a recess, a valve body having a central longitudinal axis, the valve body comprising a cavity with a fluid outlet portion, a valve needle arranged in the recess of the fluid inlet tube and movable in the cavity along the central longitudinal axis, the valve needle preventing a fluid flow through the fluid outlet portion in a closed position and releasing the fluid flow through the fluid outlet portion in other positions, a spring element and an elastic body, both arranged in parallel within the recess and interacting with a portion of the valve body on one side and with a spring rest fixed to the valve needle on another side, wherein the elastic body and the spring element are compressed in parallel as the valve needle is moved along the longitudinal axis away from its closing position, and the elastic body, in the presence of a fluid pressure in the recess, exerts a fluid-pressure-dependent longitudinal force on the valve needle.

2. An injection valve according claim 1, wherein the elastic body comprises a plastic body made from an elastomer material.

3. An injection valve according to one claim 1, wherein, during operation of the valve, the fluid pressure acts on radial side faces of the elastic body to cause the longitudinal force.

4. An injection valve according to claim 1, wherein the longitudinal force partially compensates, fully compensates, or slightly overcompensates a longitudinal force on the valve needle caused by the fluid pressure.

5. An injection valve according to claim 1, wherein the spring element and the elastic body are both seated against the spring rest.

6. An injection valve according to claim 1, wherein the elastic body comprises an elastic ring arranged in a plane extending perpendicularly to the longitudinal axis.

7. An injection valve according to claim 1, wherein, in the absence of a fluid pressure and in the closing position of the valve, the elastic body is squeezed by at least 5% and by at most 25% of its original longitudinal extension.

8. An injection valve according to claim 1, wherein the injection valve comprises an electromagnetic actuator unit designed such that a gradient of the magnetic force along the longitudinal axis is less than a spring rate of the valve.

9. An injection valve according to claim 1, wherein the injection valve is of an outward opening type.

10. An injection valve according to claim 1, wherein the injection valve is of an inward opening type.

* * * * *